US005756927A

United States Patent [19]

Fixell et al.

[11] Patent Number: 5,756,927

[45] Date of Patent: May 26, 1998

[54] METHOD OF ARMING AND ARRANGEMENT FOR CARRYING OUT THE METHOD

[75] Inventors: Tomas Fixell, Gothenburg; Leila Ohman-Denton, Nol, both of Sweden

[73] Assignee: BOFORS AB, Karlskoga, Sweden

[21] Appl. No.: 696,817

[22] PCT Filed: Feb. 16, 1995

[86] PCT No.: PCT/SE95/00161

§ 371 Date: Oct. 10, 1996

§ 102(e) Date: Oct. 10, 1996

[87] PCT Pub. No.: WO95/22738

PCT Pub. Date: Aug. 24, 1995

[30] Foreign Application Priority Data

Feb. 21, 1994 [CH] Switzerland ..... 9400576

[51] Int. Cl.[6] ..... F42C 15/40; F23Q 7/02

[52] U.S. Cl. ..... 102/264; 102/215

[58] Field of Search ..... 102/264, 215, 102/221, 200

[56] References Cited

U.S. PATENT DOCUMENTS

| | | | |
|---|---|---|---|
| 3,153,520 | 10/1964 | Morris . | |
| 3,750,583 | 8/1973 | White et al. | 102/215 |
| 3,890,901 | 6/1975 | Anderson et al. | 102/264 |
| 4,096,802 | 6/1978 | Waln | 102/215 |
| 4,099,466 | 7/1978 | Redmond et al. | 102/215 |
| 4,137,850 | 2/1979 | Donner | 102/215 |
| 4,375,192 | 3/1983 | Yates et al. | 102/215 |
| 5,245,926 | 9/1993 | Hunter | 102/215 |

FOREIGN PATENT DOCUMENTS 3 543 938 of 1987 Germany .

*Primary Examiner*—Michael J. Carone
*Assistant Examiner*—Theresa M. Wesson
*Attorney, Agent, or Firm*—Pollock, Vande Sande & Priddy

[57] ABSTRACT

A method and apparatus for determining whether a warhead in flight and forming a part of a rocket, missile, or the like, is in a state which permits arming of the warhead. The arming of the warhead depends upon the conditions of the warhead's movement and the elapsed time from its launching. A specific time slot which begins at a predetermined time after the launching of the warhead and terminates at a predetermined time thereafter is demarcated. The velocity of the warhead is measured following its launch and at least during the specific time slot. The warhead will be armed only in the event that the measured velocity of the warhead has reached at least a predetermined value within the specific time slot.

6 Claims, 3 Drawing Sheets

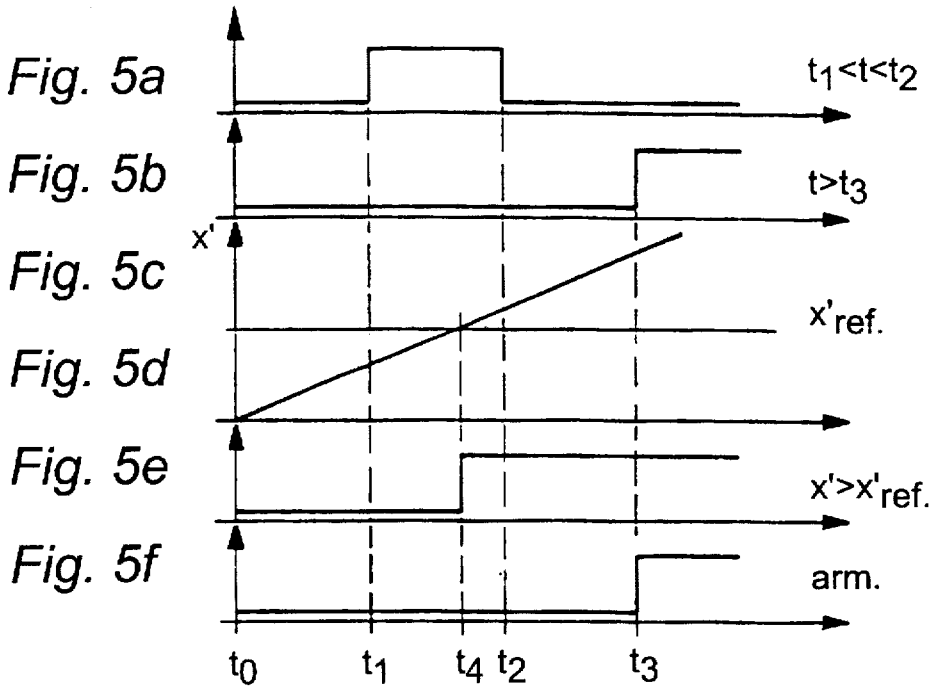
Fig. 6
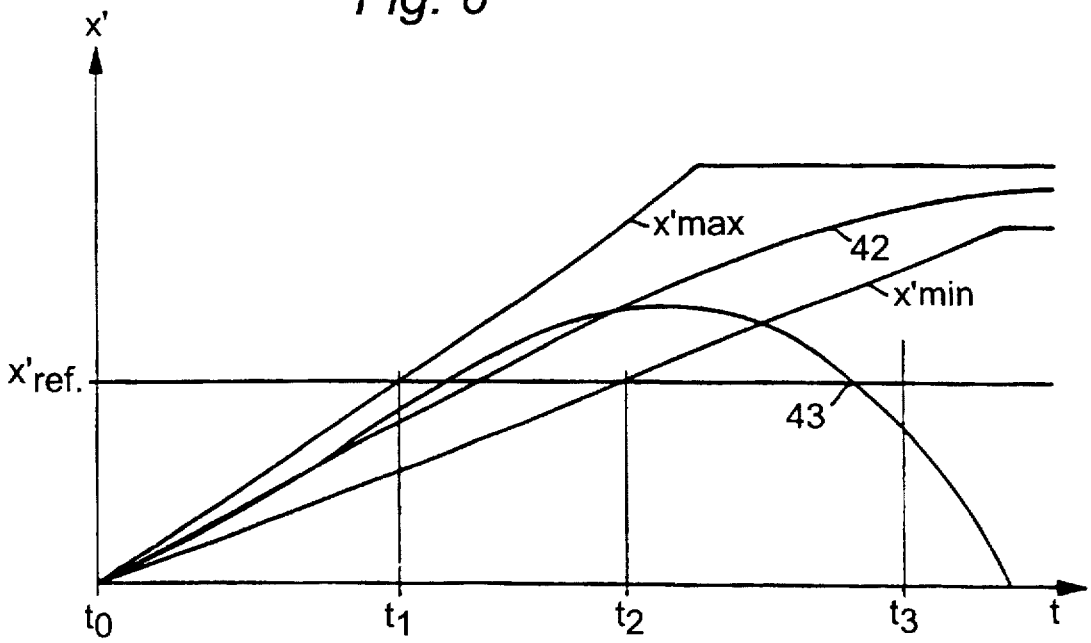

METHOD OF ARMING AND ARRANGEMENT FOR CARRYING OUT THE METHOD

BACKGROUND OF THE INVENTION

The present invention relates to a method and an apparatus for determining whether a warhead, which is in flight and which forms part of a rocket, missile or similar device, is in a state which permits arming, the said arming being based on movement conditions and time conditions which have been preset for the warhead. The arrangement includes an acceleration sensor and an integrator which is coupled to the acceleration sensor for determining the speed of movement of the warhead, as well as a comparator for comparing the speed of movement which has been determined with a reference speed.

Electrical initiation systems for missiles include a number of circuit safety devices, for example three. A general requirement is that the circuit safety devices included must be independent of one another in the sense that a fault will affect only one circuit safety device. A first circuit safety device can consist of a mechanically manoeuvred contact coupled to the separation of the booster rocket from the missile. Second and third circuit safety devices may consist of transistor switches controlled by signals originating in an acceleration signal. The transistor circuits are controlled by arming conditions.

It has been proposed previously to base the arming conditions on the flight speed x' of the missile and on the distance flown from launch x, in parallel with two time limits $t_{ref1}$, $t_{ref2}$. The following arming conditions have been drawn up in this connection:

$$\text{arm } 1=(x'>x'_{ref})\times(t>t_{ref1})$$

$$\text{arm } 2=(x>x_{ref})\times(t>t_{ref2}),$$

where t=0 at missile launch.

However, the proposed arming conditions have the disadvantage that they are not independent and that certain individual faults in the accelerometer can have disastrous consequences. For example, if the accelerometer wrongly gives a signal for maximum forward acceleration, this results in incorrect or false arming.

SUMMARY OF THE INVENTION

The object of the present invention is to develop a procedure and an arrangement for determining whether a warhead which is in flight is in a state which permits arming and which applies arming conditions which provide increased reliability. By means of the procedure and the arrangement, all dangerous faults in and around the accelerometer can be detected, all dangerous flights of the missile can be detected, a minimum arming distance can be guaranteed, and abnormally high ageing of the accelerometer can be detected, for example due to incorrect storage, etc.

The object of the invention is achieved by means of a procedure characterized in that the speed of the warhead is detected and compared with a reference speed, in that the time when the speed of the warhead reaches the reference speed is checked against a specified time slot with a time limit and an upper time limit defined as "first" and "second" times, respectively, and related to the launch time of the warhead, and in that arming is permitted only when the reference speed is reached within the specified time slot, i.e.

between the first and second times, and by means of an arrangement characterized in that a timing circuit is set up to generate, in relation to the launch time of the warhead, a time slot with a lower time limit at a first time and an upper limit at a second time, and in that a logic circuit is arranged to permit arming only if the speed of movement of the warhead reaches the reference speed during the generated time slot.

Regarding the speed signal x', which is preferably obtained from an acceleration signal x", it is therefore required that the condition $x'>x'_{ref}$ be fulfilled within the time slot. The lower and upper time limits of the time slot are chosen such that the fastest and the slowest missiles permitted are included in the time slot for the chosen reference speed $x'_{ref}$.

According to an advantageous embodiment, the speed of the warhead is checked against the reference speed at a third time which is later in time than the second time. The inclusion of this check guarantees the shortest possible arming distance defined by the third time, which time is also called the "end time". If any fault occurs then, for example an erroneous accelerometer signal due to interruption, incorrect launching sequence etc., this will be detected in the time slot or at the end time. By analyzing a speed signal, which has been obtained from the acceleration signal, with the aid of the time slot and end time, dangerous faults and sequences can be detected and arming can be prevented.

According to another advantageous embodiment, the arrangement is divided into two separate circuits which are connected to a common acceleration sensor, these circuits each comprising an integrator, a comparator, a timing circuit and a logic circuit. Two independent arming conditions are obtained in this way.

The timing circuit advantageously comprises members for generating a voltage ramp and comparison members which compare the generated voltage ramp with the reference values for forming a time slot. Such an arrangement can easily be realized and is suitable for the demanding environment in which it is intended to function.

The logic circuit can be made up of SR flipflops and logic gates.

BRIEF DESCRIPTION OF THE INVENTION

The invention will be described in greater detail below, with reference to the attached drawings in which.

FIGS. 5*a*–5*f* shown

FIG. 5 shown a time chart illustrating the principles according to the invention; and FIG. 6 shows a further chart illustrating the principles according to the invention.

DETAILED DESCRIPTION OF THE PREFERRED EMBODIMENT

Figure 1:
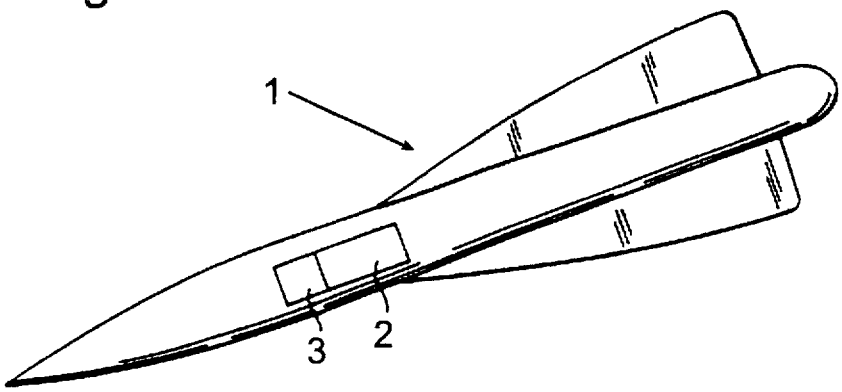
FIG. 1 shows schematically a missile which is provided with the arming function according to the invention.

The missile 1 shown in FIG. 1 comprises a schematically indicated warhead 2 of conventional type and is not discussed any further here. An arming unit 3 verifies that the arming conditions which have been set are satisfied and, if the said conditions are satisfied, effects arming of the warhead 2.

Figure 2:
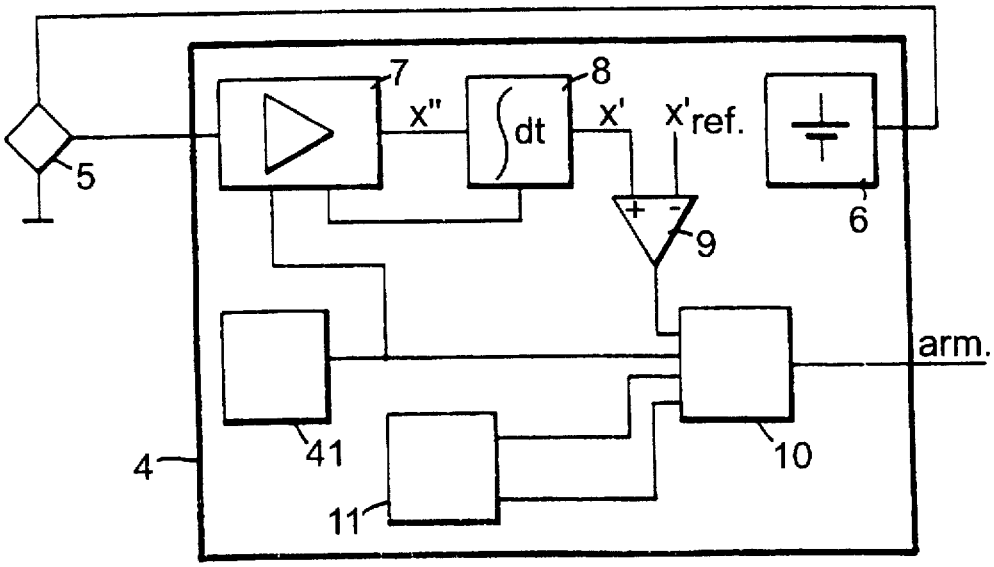
FIG. 2 shows an example of a circuit operating according to the principles of the invention.

For verifying the arming conditions, a circuit 4 according to FIG. 2 and preferably in the form of an ASIC circuit is included. An acceleration sensor 5 is connected to the circuit 4. The acceleration sensor emits a sensor signal x" to the circuit 4, which signal indicates the acceleration to which the sensor and circuit are subjected at that particular moment. The acceleration sensor is fed from a battery 6 in the circuit 4. After it has been amplified in an amplifier unit 7, the sensor signal of the acceleration sensor is integrated in an integrator 8 to obtain a speed signal x'. For zero holding, there is a feedback coupling between integrator 8 and amplifier unit 7. The output signal from the integrator 8 is supplied to a comparator 9. In the comparator 9, the speed signal x' is compared with a reference speed signal $x'_{ref}$. The comparator output is connected to an input on an arming logic circuit 10. Other inputs on the arming logic circuit 10 are connected to outputs on a timing circuit 11.

Figure 3:
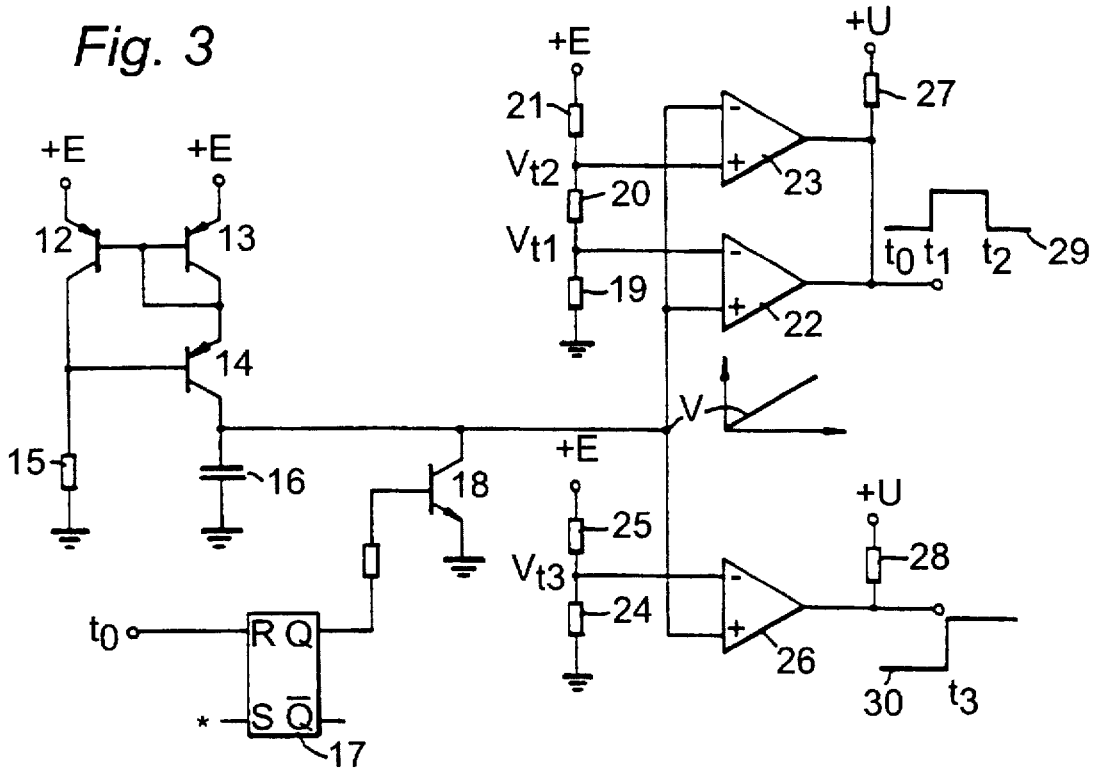
FIG. 3 shows an example of an embodiment of a timing circuit which forms part of the circuit according to FIG. 2.

FIG. 3 shows an example of the structure of the timing circuit 11. A voltage ramp v is generated with the aid of a circuit coupling comprising three transistors 12, 13, 14, a resistor 15 and a capacitor 16 which are coupled in the manner shown in the figure. An SR flipflop 17 activated at time $t_0$ causes a conducting transistor 18 to change over to a non-conducting state. The formation of the voltage ramp v is thus begun. The derivative of the ramp v is essentially determined by the resistance R of the resistor 15 and the capacitance C of the capacitor 16. With the aid of a voltage divider comprising three resistors 19, 20, 21 connected in series, voltages $v_{t1}$ and $v_{t2}$ are generated, which together with the voltage ramp v determine the time slot. A comparator 22 compares the ramp voltage v with the voltage $v_{t1}$. A second comparator 23 compares the voltage ramp v with the voltage $v_{t2}$. At the connected outputs of the comparators 22 and 23, a relatively high voltage is obtained during the time $t_1$ to $t_2$, which voltage defines the time slot, as has been schematically indicated by the curve shape 29. A resistor 27 is coupled-in between the connected outputs and a voltage source U.

A third time or end time $t_3$ is obtained in a manner corresponding to that in which the times $t_1$ and $t_2$ are obtained. The voltage $v_{t3}$ is generated with the aid of a voltage divider having two resistors 24, 25 which are connected in series. A comparator 26 compares the voltage ramp v with $v_{t3}$ and indicates, with a higher voltage at its output, that the voltage ramp v has passed the voltage $v_{t3}$, which sequence has been schematically indicated by the curve shape 30. A resistor 28 is coupled-in between the output of the comparator 26 and the voltage source U.

Figure 4:
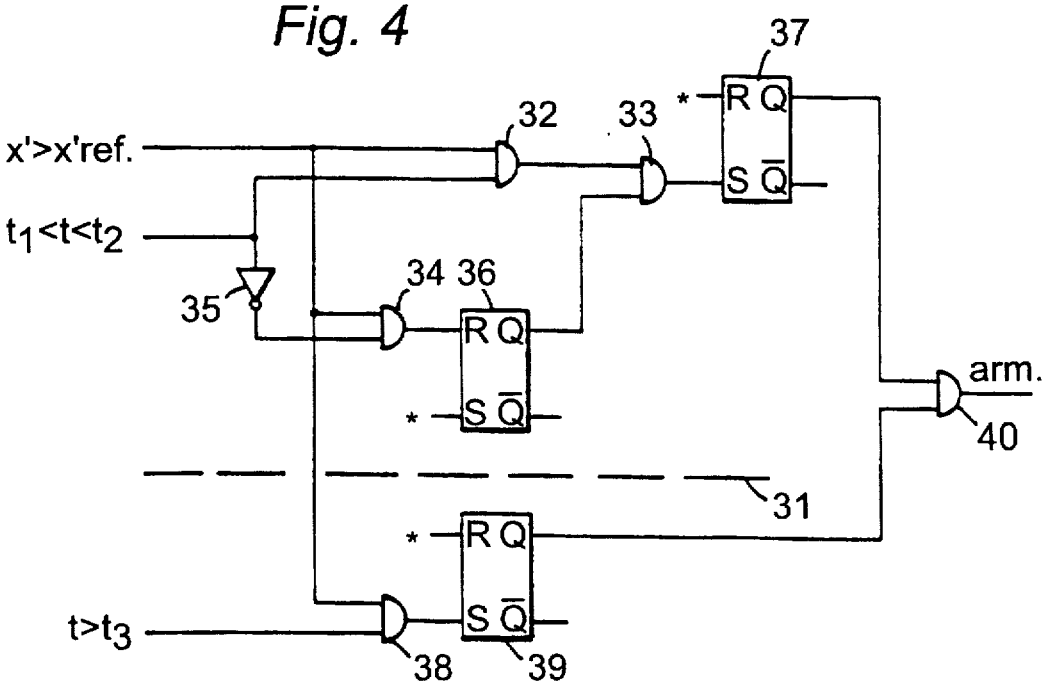
FIG. 4 shows an example of an embodiment of an arming logic circuit which forms part of the circuit according to FIG. 2.

As a function of the information supplied from the timing circuit 11 and the comparator 9, the logic circuit shown in more detail in FIG. 4 establishes whether the conditions for arming are satisfied. From the comparator 9, the logic circuit obtains information on the speed signal $x'>x'_{ref}$. The timing circuit gives the logic circuit information on when the time slot occurs, i.e. when $t_1<t<t_2$, and whether the end time has been reached, i.e. $t>t_3$. The logic circuit consists of two parts schematically separated by means of a broken line 31. In the upper part, an analysis is made of whether the speed condition is satisfied in the time slot. For the analysis there are three AND gates 32, 33, 34, an inverter 35 and two SR flipflops 36, 37 which are connected in the manner shown in the figure. In the lower part, an analysis is made of whether the speed condition is satisfied at the end time $t_3$. This analysis is carried out with the aid of an AND gate 38 and an SR flipflop 39. The result of the analysis in the upper part and lower part is supplied to an AND gate 40 which at its output indicates whether the arming conditions set are satisfied and, if such is the case, triggers the arming sequence. If analysis is required only in accordance with the upper part or in accordance with the lower part, the AND gate 40 and the unwanted analysis part can be omitted. The arrangement is reset by activating the *-marked inputs of the SR flipflops from a resetting block 41 shown in FIG. 2.

FIGS. 5*a*–5*f* show a time chart illustrating the analysis of arming conditions. FIG. 5*a* shows the time-related position of the time slot, where $t_1$ defines the start time of the slot and $t_2$ defines the end time of the slot. FIG. 5*b* shows the position of the end time $t_3$. FIG. 5*c* shows the speed signal x' and the reference speed $x'_{ref}$ as a function of the time. It may be noted here that the speed signal passes the level of the reference signal during the time slot at a time $t_4$. FIG. 5*e* shows that the speed condition is satisfied as from the time $t_4$. FIG. 5*f* shows that both the arming conditions according to FIG. 5*b* and FIG. 5*e* are satisfied as from the time $t_3$.

In the time chart shown in FIG. 6, the maximum and minimum speed signals which are permitted within a time slot have been marked as $x'_{max}$ and $x'_{min}$, respectively. Curve 42 is an example of a speed signal which satisfies the arming conditions set, both as regards time slot and end time. Arming can be initiated. In contrast, curve 43 negotiates the time slot, but not the end time. Arming is not permitted.

We claim:

1. A method for determining whether a warhead in flight and forming a part of a rocket, missile, or projectile is in a state which permits arming of the warhead dependent upon the conditions of its movement and the elapsed time from its launching, comprising the steps of:

a. demarcating a specific time slot beginning at a predetermined time after the launching of the warhead and terminating at a predetermined time "thereafter";

b. measuring the velocity of the warhead following its launching and at least during said demarcated specific time slot; and c. arming the warhead only in the event that the measured velocity of the warhead at least reaches a predetermined value within said demarcated specific time slot.

2. The method of claim 1 comprising the further step of:

demarcating a further time following said specific time slot; and arming the warhead only when the measured velocity of the warhead also maintains a velocity above a predetermined value at said further time.

3. The method of claim 2 in which the arming of the warhead is enabled only in the event that the measured velocity of the warhead does not exceed a predetermined higher value during said specific time slot.

4. The method of claim 3 in which the arming of the warhead is disabled in the event that the measured velocity of the warhead is less than a predetermined value at said further time.

5. Apparatus for determining whether a warhead in flight and forming a part of a rocket, missile, or projectile is in a state which permits arming of the warhead dependent upon the conditions of its movement and the elapsed time from its launching, comprising:

first means for continuously measuring the velocity of the warhead from its moment of launching;

second means for demarcating a predetermined time slot commencing at a predetermined time following the instant of launching of the warhead; and control means responsive to both said first and said second means for arming the warhead only in the event that during said time slot the velocity of the warhead maintains a value within a predetermined range.

6. The apparatus of claim 5 in which a third means permits arming of said warhead only in the event that the velocity of said warhead is maintained above a predetermined value at a further time.

* * * * *

UNITED STATES PATENT AND TRADEMARK OFFICE

CERTIFICATE OF CORRECTION

PATENT NO. : 5,756,927

DATED : May 26, 1998

INVENTOR(S) : Fixell, et. al.

It is certified that error appears in the above-indentified patent and that said Letters Patent is hereby corrected as shown below:

Title page, item [75], inventor's address should read --Goteborg--.

item [30], Priority Data should read -- [SE] Sweden--.

Claim 1, line 8, delete the quotations around thereafter.

Signed and Sealed this

Twenty-eighth Day of July, 1998

*Attest:*

*Attesting Officer*

BRUCE LEHMAN

*Commissioner of Patents and Trademarks*